US005706257A

United States Patent [19]

Rothman et al.

[11] Patent Number: 5,706,257

[45] Date of Patent: Jan. 6, 1998

[54] PREPROGRAMMED MEDICATION REMINDER

[75] Inventors: Michael Rothman, Newton; Michael Heffernan, Hingham, both of Mass.; Dixon Newbold, Glocester, R.I.

[73] Assignee: Health Solutions, L.L.C., Providence, R.I.

[21] Appl. No.: 681,934

[22] Filed: Jul. 29, 1996

[51] Int. Cl.[6] ..... G04B 47/00; G07F 11/00

[52] U.S. Cl. ..... 368/10; 221/2

[58] Field of Search ..... 368/10, 250, 251; 221/2, 3, 15; 349/309.15, 309.4; 364/569

[56] References Cited

U.S. PATENT DOCUMENTS

| | | | |
|---|---|---|---|
| 4,293,845 | 10/1981 | Villa-Real | 340/309.3 |
| 4,419,016 | 12/1983 | Zoltan | 368/10 |
| 4,483,626 | 11/1984 | Noble | 368/10 |
| 4,526,474 | 7/1985 | Simon | 368/10 |
| 4,731,765 | 3/1988 | Cole et al. | 368/10 |
| 4,748,600 | 5/1988 | Urouart | 368/10 |
| 5,157,640 | 10/1992 | Rackner | 368/10 |
| 5,602,802 | 2/1997 | Leigh-Spencer | 368/10 |

*Primary Examiner*—Vit W. Miska

*Attorney, Agent, or Firm*—Lockwood, Alex, Fitzgibbon & Cummings

[57] ABSTRACT

A device and method for encouraging proper timing compliance in accordance with a medication prescription regimen. The device is preprogrammed so as to be tailored for the particular prescription regimen to be complied with. Appropriate circuitry is provided in order to generate a dosage signal, which dosage signal persists and changes in an easily recognizable manner until compliance with that dosage requirement is indicated by interacting with the device. Also included is circuitry for prompting compliance with refill requirements of the prescription. The device includes a casing which can have members for facilitating stand-up display or hang-up display of the device.

18 Claims, 3 Drawing Sheets

PREPROGRAMMED MEDICATION REMINDER

DESCRIPTION

BACKGROUND AND DESCRIPTION OF THE INVENTION

The invention generally relates to medication reminder systems of the type that are suitable for in-home use while being sufficiently portable to be suitable for use away from the home. More particularly, the present invention relates to an improved device and method for prompting compliance with a medication administration regimen while also prompting medication refill on a timely basis.

Pharmaceutical and medical professionals have long recognized that the effectiveness and safety of medicaments are often compromised by the failure of the patient to administer the medication in a properly timed manner. An important objective of medication administration is to maintain a proper level of medication within the bloodstream or the like over a particular treatment duration. Typically, this requires that the medication be taken on a timely basis for the duration of the prescription. Some patients are able to accomplish compliance with the prescribed regimen by the use of conventional time keeping devices. Others are unable or unwilling to use conventional means to follow the prescribed regimen.

In response to the needs of these latter groups of people, various systems have been proposed for devices that deliver alarms to indicate when a medication is to be taken and/or incorporate means to detect when a medication has been removed from its container. Examples include Zoltan U.S. Pat. No. 4,419,016, Noble U.S. Pat. No. 4,483,626, Simon U.S. Pat. No. 4,526,474, Kehr U.S. Pat. No. 4,768,176, Masse U.S. Pat. No. 4,905,213 and Backner U.S. Pat. No. 5,157,640. Often, these devices are complicated to use and difficult to set by the elderly or the infirmed. Others are technologically complicated, such as requiring computer interface mechanisms and other relatively expensive and/or technically complex systems.

Another problem which is associated with medication regimen compliance can occur in the case of long-term or virtually perpetual prescriptions. In order to maintain the constant delivery of fresh medication over extended time periods, it is necessary to have prescriptions refilled on a timely basis. Otherwise, required medication can be unavailable at a designated time, even when the patient is aware of the proper timing for taking the medication. Accordingly, there is a need for a system which will indicate in advance when a refill is needed. A presently recognized further objective in this regard is that this refill timing be controlled by the pharmacist or medical professional, rather than by the patient who might not be fully aware of the refill requirements for a particular prescription.

It has been found that, by proceeding in accordance with the present invention, it is possible to provide persistent prompts, which are timely, simple and reliable, for administering medication, typically on a self-administration basis. It has further been found to be possible to provide persistent prompts for medication refill activities which ensure that a prescription regimen proceeds uninterrupted and of the full and proper duration associated with a particular treatment.

SUMMARY OF THE INVENTION

In summary, the present invention is a system, device and method for compliance with medication prescription administration regimens while simultaneously keeping track of medication refill requirements. In the preferred arrangement which is illustrated, a dosage switch, dosage signal emitter, refill switch and refill signal emitter are housed in a compact unit which can be easily displayed at home and/or transported as desired. Included is operational circuitry which includes clock and timer circuitry and a medication dosage accumulator register. A timing circuit activates the dosage signal emitter which is capable of delivering a plurality of predetermined dosage reminder time periods during which the dosage signal emitter alternates between "on" and "off" modes. When the dosage switch is pressed after a medication is administered, the alternating signal ceases. Data circuit means are associated with the medication dosage accumulator register. After a predetermined number of doses are registered, the refill signal emitter is automatically activated. Upon this activation, the signal is emitted in alternating on-and-off fashion until the refill switch is activated. In a preferred arrangement, the alternating on-and-off signals delivered by both the dosage circuitry and the refill circuitry vary in the timing of the signals emitted during the predetermined reminder time periods. In another preferred arrangement, a second refill reminder signal period begins at a set time whether or not the refill switch had been pressed during a first refill reminder time period.

It is a general object of the present invention to provide an improved system, device and method for providing reminders in connection with the administration of medication.

Another object of the present invention is to provide an improved preprogrammed medication reminder apparatus and method which provides reminder signals in accordance with a prescribed regimen which is out of the control of the patient.

Another object of this invention is to provide an improved preprogrammed medication reminder and method which is compact and extremely easy to use and understand.

Another object of the present invention is to provide an improved device and method for improving daily compliance by the patent to a medication regimen and which increases the comfort level of the patient by indicating medication has been taken and which comforts the doctor that the patient will receive the appropriate therapy benefit.

Another object of the present invention is to provide an improved preprogrammed medication reminder and method which provides a plurality of signals which are distinctive from one another in order to readily convey changes in the timing of the reminder.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
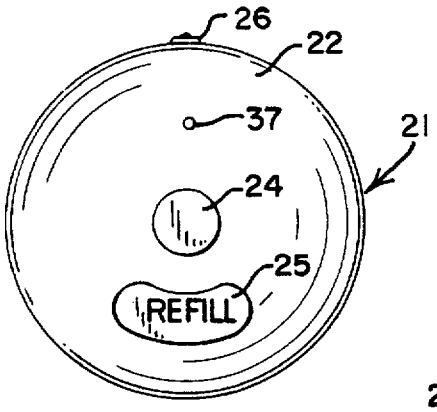
FIG. 1 is a front elevational view of a preprogrammed medication reminder in accordance with the present invention.

A preferred device suitable for prompting medication administration, prescription compliance and prescription refill timing is illustrated in FIGS. 1, 2, 3, 4, 5, 6 and 7. This device is generally illustrated by reference numeral 21. In the illustrated embodiment, a casing includes a front panel 22 and a rear panel 23 which are suitably joined together in sealed fashion.

A dosage reminder and control component 24 is illustrated within the front panel. This component 24 signals to provide dosage reminder information, as discussed in more detail herein. It also serves as a switch in order to provide input into the device. A refill reminder and control component 25 is also mounted with respect to the front panel 22. Component 25 functions to transmit signals to indicate that it is time to refill the medication prescription which is associated with the particular version of the compliance device 21. It also serves as an input pad to indicate compliance with a refill regimen.

Figure 3:
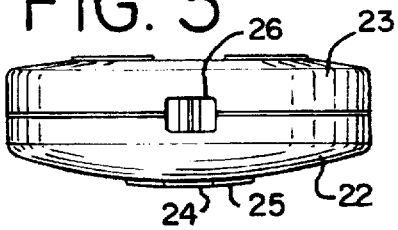
FIG. 3 is a top plan view of the device illustrated in FIG. 1.

A selector switch 26 is provided for varying the frequency of medication administration times. For example, with the illustrated switch, which is a slide switch, the central position as shown in FIG. 3 is an "off" position. When moved to the left, the switch controls the length of time between initiation of the signal given by the dosage reminder and control component 24. This is also the case when the selector switch 26 is moved to the right as shown as in FIG. 3. In a typical embodiment, when the selector switch is in the left-side position, this corresponds to a situation where the medication regimen requires twice-a-day dosage, or a dosage each twelve hours. Continuing with this illustrated arrangement, the right-side position responds to a once daily medication administration or dosage; that is, the interval is twenty-four hours. Other options are possible, such as changing between a twice-a-day regimen and a four-times-a-day regimen.

Figure 6:
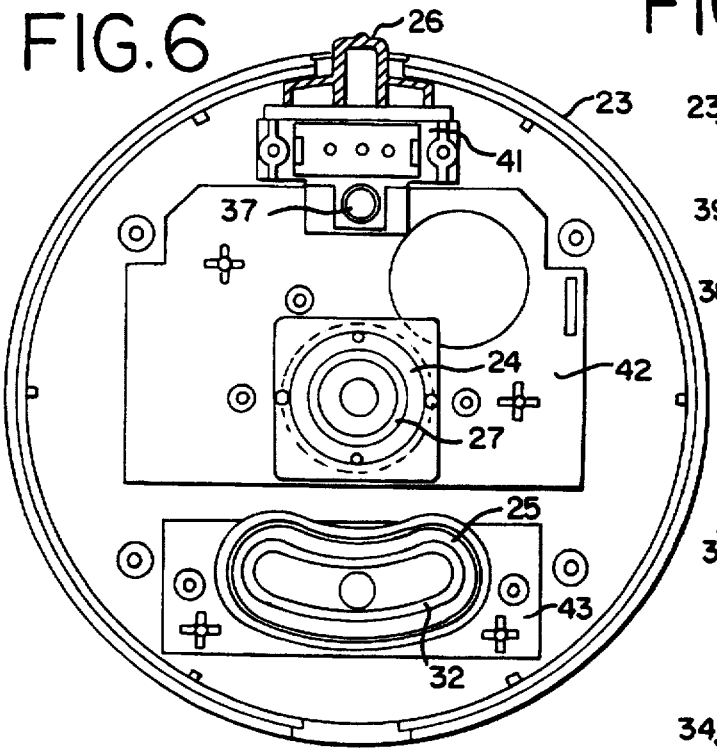
FIG. 6 is a cut-away view of the device of FIG. 1, illustrating components thereof.
Figure 7:
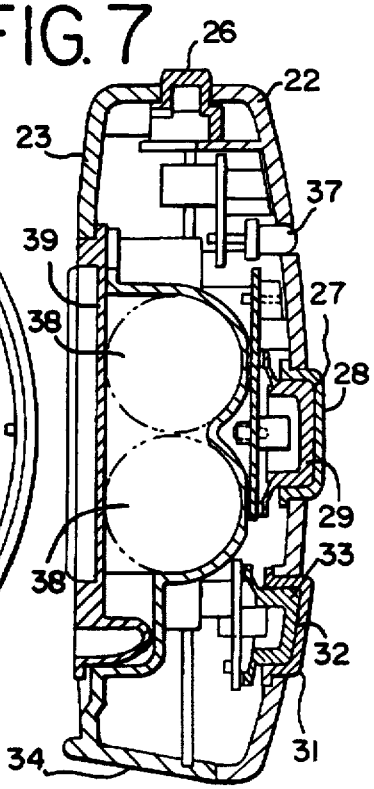
FIG. 7 is a longitudinal cross-sectional view through the device of FIG. 1.

With more particular reference to FIG. 6 and 7 and to the dosage reminder and control component 24, this includes a signal emitting member such as the illustrated Light Emitting Diode (LED) member 27. As discussed in greater detail herein, LED member 27 alternates between an "on" or lit mode and an "off" or unlit mode. A push button including a flexible component 28 (which can be made of silicone for example) through which the LED will shine is combined with a more rigid push button component 29 of known construction which operates as a switch with respect to the circuitry discussed herein. Similarly, refill reminder control component 25 includes a flexible push button component 31 (such as a generally transparent or translucent silicone cover) over an LED member 32 and over a more rigid push button component 33.

Figure 4:
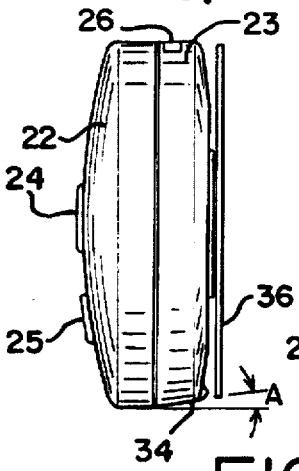
FIG. 4 is a side elevational view of the device illustrated in FIG. 1, shown in an orientation whereby it is suspended from a vertical surface.
Figure 5:
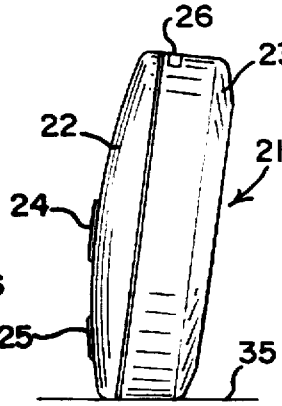
FIGS. 5 is a side elevational view of the device shown in FIG. 1 illustrating its ability to be self-standing on a horizontal surface.
Figure 2:
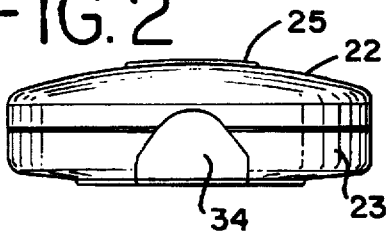
FIG. 2 is a bottom plan view of the device illustrated in FIG. 1.

With further reference to the casing, same preferably includes a chamfer 34 (FIG. 2 and FIG. 7) on its bottom surface. The chamfer is at an angle "A" with respect to horizontal when the device 21 is in a true vertical orientation, as is illustrated in FIG. 4. When the device 21 rests on a horizontal surface 35, it will rest at angle A, as generally shown in FIG. 5. Thus, the device will stand up on a tabletop, counter or the like, and the display components will be oriented for easy viewing. When it is desired to mount the device 21 to a vertical surface such as the wall of a refrigerator, a magnetic plate 36 is secured to the rear panel 23 as shown in FIG. 4.

Also present on the illustrated device 21 is a further signal member 37. This can take the form of a light or an LED which illuminates in conjunction with a "change battery" function. For example, the operational circuitry discussed herein will activate signal member 37 after a predetermined number of dosages have been signalled, such as by pressing the switch of the dosage reminder and control component 24 for a designated number of times. For example, 180 hits would designate that a one-a-day dosage has proceeded for about one-half of a year, approximating a reasonable life of batteries 38 (FIG. 7) which power the device 21. In a preferred arrangement, the signal member 37 will flash until the batteries 38 are totally drained or until the batteries are replaced or recharged which is facilitated by removal of access panel 39. A preferred flash pattern will alternate 0.5 second in the "on" mode and 0.5 second in the "off" mode. This signal will tell the patient that it is time to change or charge the batteries. If there is no compliance with this requirement, the device 21 eventually will no longer work due to the battery drain which is mandated when this circuitry is implemented as discussed.

Each of the dosage reminder and control component 24, the refill reminder and control component 25, the selector switch 26 and the signal member 37 are suitably and controllably interconnected with operational circuitry which can be provided according to suitable technology, such as printed circuit boards 41, 42 and 43 as illustrated in FIG. 6. The batteries 38 provide the required power for this circuitry.

In the illustrated arrangement, the power will be initiated, together with the timer circuitry discussed herein, when a suitable initiation step is carried out. This can be achieved when the selector switch 26 is moved from its off position. This should be done at the beginning of the first day of the prescription regimen period which is overseen by the device 21. Confirmation of this "power up" mode can be signaled by flashing of one, some or all of the signal members 24, 25, 37. This will activate the device, and dosage signalling as discussed herein will proceed in accordance with the periodic timing selected, such as once every twelve hours. The correspondence of this periodic timing with a time of day is determined by the time of day that this activating step is accomplished. Thus, if there is a desire to take medication on a twelve-hour periodic basis at 8:00 a.m. and at 8 p.m., this activation step should be carried out at about 8 a.m. or about 8 p.m. (or some minutes sooner if there is a desire to provide a signal in advance of the desired dosage time).

Figure 8:
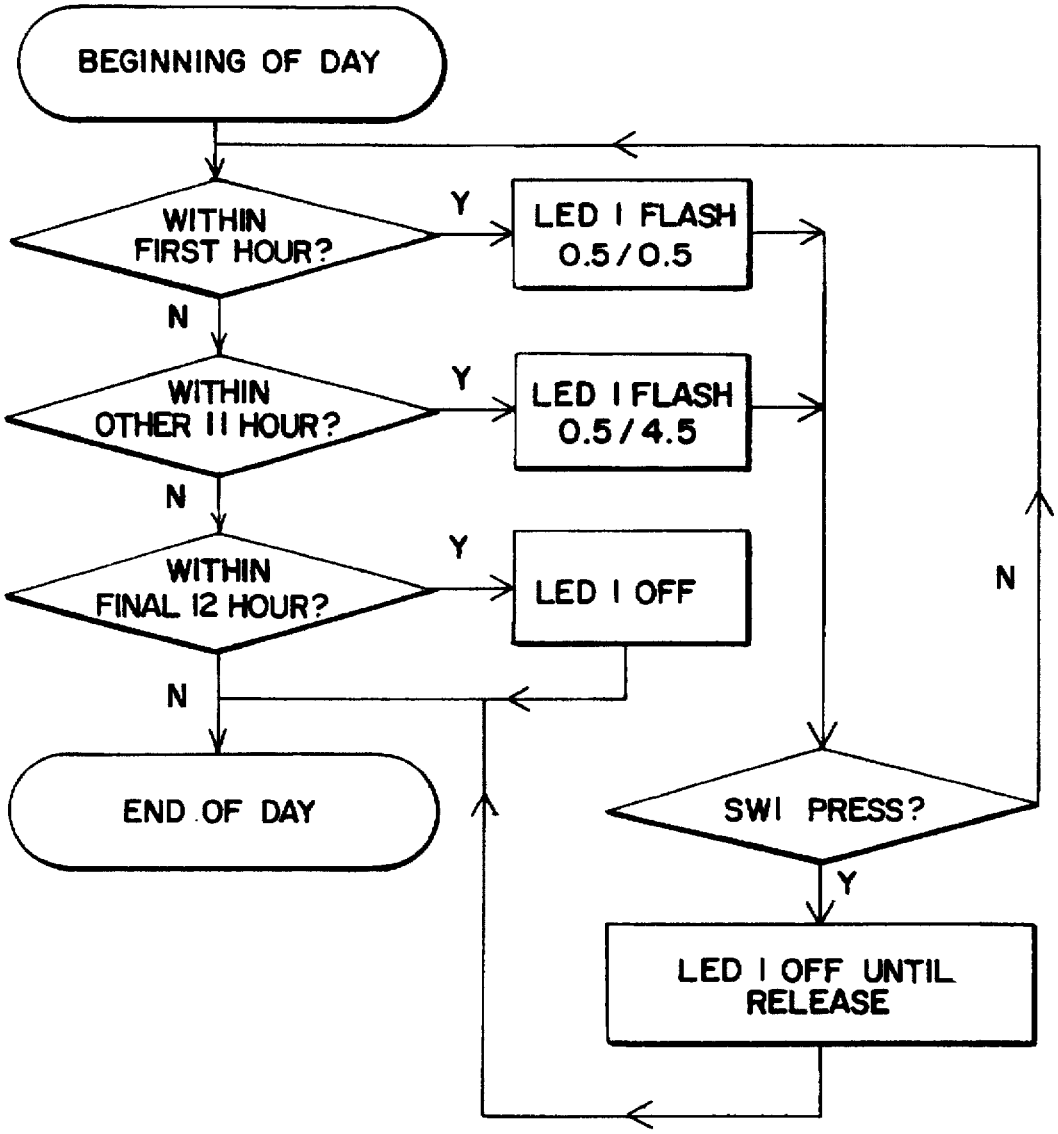
FIG. 8 is a flow chart illustrating certain features of data channel circuitry associated with the dosage reminder aspect of the invention.

Reference is now made to the schematic presentation in FIG. 8. LED member 27 of the dosage reminder and control component 24 as illustrated in FIGS. 1 through 7 is designated as LED 1 in FIG. 8. Similarly, the switch component of the dosage reminder and control component 24 is designated as SW 1 in FIG. 8. FIG. 8 generally illustrates the clock and timer circuitry such as that present on printed circuit board 42. Suitable interfaces and drivers are included in accordance with generally known principles.

FIG. 8 illustrates the operational features of the device with respect to the preprogrammed dosage medication reminder activity provided by the invention. Once the device is activated as discussed herein, this clock and timer circuitry will control operation of the signal emitter, which is LED 1 in this illustration. When it is time to administer the medication, LED 1 will flash for one hour. In the illustrated embodiment, the flashing turns the LED 1 on for 0.5 second followed by having the LED 1 off for 0.5 second. If the medication is administered, this compliance will be indicated by pressing the dosage reminder and control component 24, and LED 1 will remain in the "off" mode until the predetermined time for the next dosage.

If there is no compliance within this first hour of flashing, the clock and timer circuitry will continue with the flashing of LED 1, except the timing will be changed. In the preferred embodiment as illustrated, this second-tier timing has LED 1 on for 0.5 second and off for 4.5 seconds. Typically, this second-phase signalling will continue for a longer period than does the first-phase signalling. FIG. 8 illustrates the situation where medication is to be administered once each day, and the second-phase signalling will end after half of this twenty-four-hour has elapsed. In the third phase, LED 1 remains off.

If SW 1 is not pressed during any particular period of the regimen, the clock and time circuitry will continue to cycle so that the dosage reminder will again be activated at the designated, set time. Thus, the device remains on the proper regimen even if there is a lapse in compliance with a particular dosage requirement or if the medication was properly administered but the patient or user simply forgot to press the dosage reminder and control component 24.

The device 21 is also set so that the number of dosages in the cycle sequence corresponds to the prescribed total number of doses. Thus, if the prescription is for thirty days, and if the medication is to be administered twice a day, device 21 will be set such that its cycle will last through sixty doses. This aspect of the device is advantageously taken out of the control of the patient or user. Typically, the cycle duration element as just discussed is set during manufacturing of the device. With this arrangement, the pharmaceutical or medical professional then will provide the patient or user with a device that is properly set so as to correspond with the prescription duration. This ensures greater control by the medical professional and also avoids a complexity factor which would otherwise be present were the patient or user able to vary the prescription cycle duration.

Figure 9:
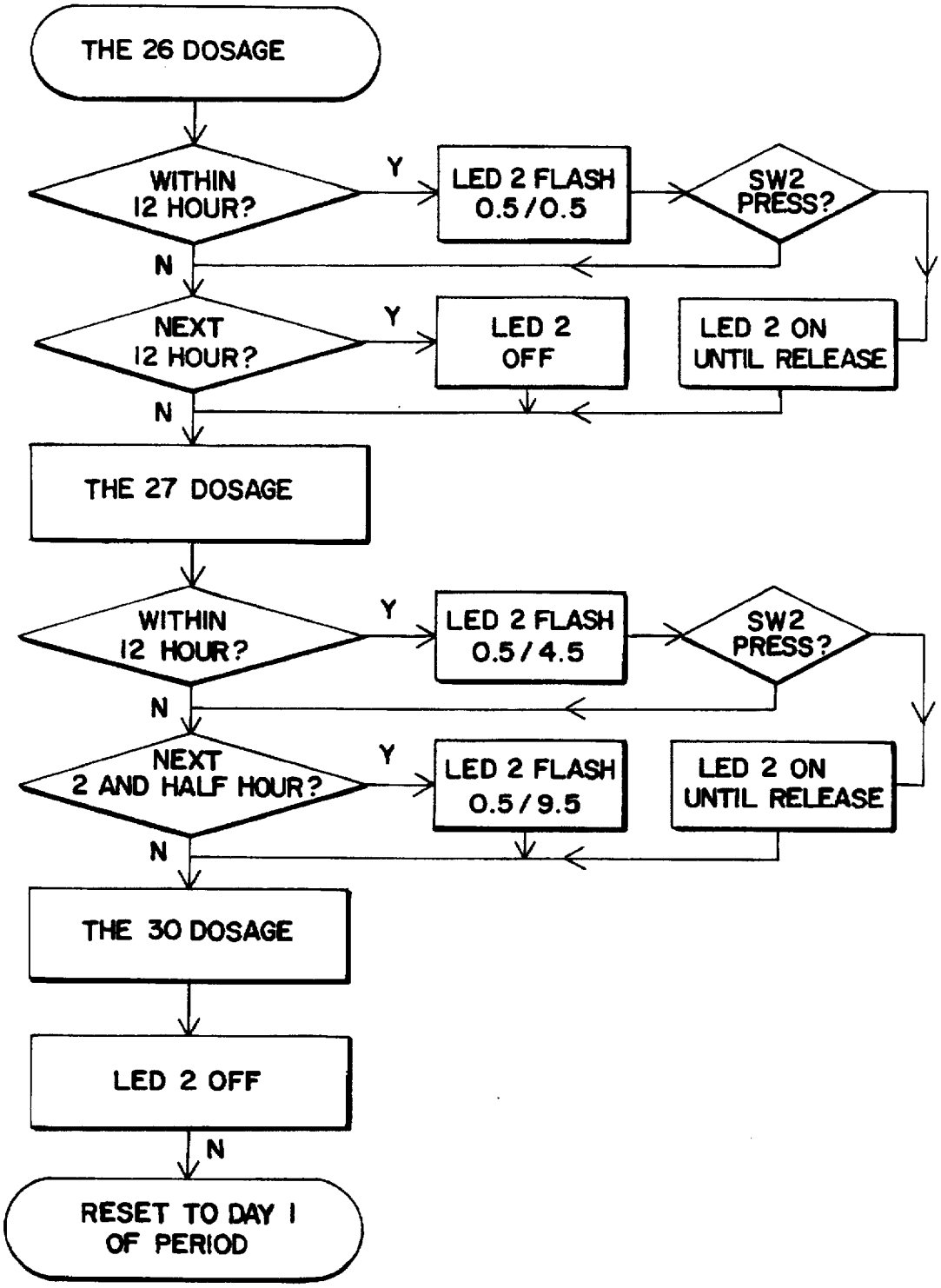
FIG. 9 is a flow chart illustrating certain features of data channel circuitry associated with the refill reminder aspect of the invention.

Further details of the prescription cycle duration feature are illustrated in the schematic presentation of FIG. 9. This illustrates a refill feature wherein a medication dosage accumulator register automatically counts the number of times medication has been administered. A set number of days (for example five days) before the end of the prescription cycle duration, the refill signal emitter will be activated. The illustrated emitter is refill switch or refill reminder and control component 25 and its LED member 32.

Concerning the schematic presentation illustrated in FIG. 9, this illustrates the situation where the prescription is for thirty days, and the medication is to be administered once a day. The LED 2 corresponds to LED member 32 of FIG. 7, and SW 2 corresponds to the switch component of the refill reminder and control component 25. Once the 26th dosage is achieved by administering the medication for the 26th time during the particular prescription, the refill signalling feature initiates. With the illustrated FIG. 9 arrangement, LED 2 will then flash alternating "on" for 0.5 second and "off" for 0.5 second. This will continue for twelve hours or until SW 2 is pressed.

Whether or not SW 2 has been pressed at this stage, the circuitry will provide a second signal in the illustrated embodiment, this being once the 27th dosage has been administered. For a set time period, twelve hours being indicated in FIG. 9, LED 2 will flash with the sequence of 0.5 second on and 4.5 seconds off until SW 2 is pressed. If SW 2 is not pressed during this set time period, then LED 2 will flash at a slower rate, 0.5 second "on" and 9.5 seconds "off" as illustrated. This will continue for the next designated time period (2½ hours being shown in FIG. 9) or until LED 2 is pressed.

With such an arrangement, and referring to the illustrated embodiment, when the signalling is given after the 26th dosage, this is to inform the appropriate person that it is time to refill the prescription. The second signalling regimen, after the 27th dosage in the FIG. 9 embodiment, is to provide a further reminder. If scheduling constraints permit, the user's response to the first signalling regimen will indicate that the message has been received that a prescription refill is needed, and the acknowledgement of the second signalling regimen will indicate that the prescription refill has been obtained.

Other embodiments concerning the refill feature can be practiced. For example, the refill reminder and control component can remain activated for a longer time period, for example, for a full five days of flashing until such time as SW 2 is pressed. With this approach, the patient or user will press SW 2 when the prescription refill is in hand. Typically, this signalling will be at a slow flashing rate so as to minimize battery drain and so as to indicate that same is a long-term signal.

Other illustrated options which will vary the duration cycle of the prescription are as follows. When the prescription is for a 30-day period and when the medication timing is twice each day, LED 2 initiates on the 26th day, but after 52 dosages have been registered. When the prescription duration is 60 days, and when it is a one-a-day prescription, LED 2 initiates at 56 days and at 56 dosages. When the 60-day prescription is a prescription to be taken twice each day, the LED signal begins at 112 dosages. When a 90-day prescription and a once-a-day dosage regimen, the LED 2 first illuminates at 86 days and at 86 dosages. For a 90-day prescription on the basis of twice each day is required, LED 2 initiation starts at 86 days and at 172 dosages. Corresponding second-phase initiation of LED 2 will likewise vary accordingly.

It will be appreciated that, with respect to the multiple-phase signalling aspect of the present invention, the patient or user will recognize that a more frequent flashing display indicates that one is approximately at the proper time to act, such as to administer a dosage of medication. When the signal decreases in frequency, this means that compliance is overdue. An even slower frequency can indicate that one is well beyond the desired compliance time. Thus, without requiring complicated arrangements or signals, the user can be notified that compliance has not as yet occurred, while also gaining an indication as the urgency for moving back into compliance. Typically, this is done so that compliance signals will not be spaced too closely to each other so as to avoid the possibility of an overmedication condition when a very late compliance is followed by an on-time compliance. Because this timing is not modifiable by the user or patient, there is less of a risk of improper medication delivery. When thus properly preprogrammed, the device is reusable without modification by the professional so long as the prescription duration and regimen remains constant. When there is a change, this will be handled by substituting a different pre-programmed device, unless movement of the selector switch can achieve a desired change, such as varying the time between medication administration.

It will be understood that the embodiments of the present invention which have been described are illustrative of some of the applications of the principles of the present invention. Various modifications may be made by those skilled in the art without departing from the true spirit and scope of the invention.

We claim:

1. A preprogrammed medication reminder, comprising:

a casing;

a dosage switch and a dosage signal emitter supported by said casing;

a refill switch and a refill signal emitter supported by said casing;

clock and timer circuitry for controlling said dosage signal emitter and said refill signal emitter and for responding to said dosage switch and to said refill switch;

a medication dosage accumulator register;

timing circuit means of said clock and timer circuitry, said timing circuit means activates said dosage signal emitter during at least a first one of a plurality of predetermined dosage reminder time periods, said timing circuit means delivering the dosage signal during timed turned-on periods which alternate with timed turned-off periods during which the dosage signal emitter is off, said turned-on periods and said turned-off periods vary in relative respective frequency during said dosage reminder time periods;

said dosage switch, when activated, terminates the timed turned-on periods and turned-off periods of the dosage signal emitter and registers the dose delivery on said dosage accumulator register;

data circuit means associated with said medication dosage accumulator register, said data circuit means activates said timing circuit means after a predetermined number of doses are registered on said dosage accumulator register by said actuation of the dosage switch, said timing circuit means activates said refill signal emitter during at least a first refill reminder time period and delivers the signal during timed turned-on periods which alternate with timed turned-off periods during which the refill signal emitter is off; and said refill switch, when activated during said first refill reminder period, terminates said first refill reminder time period.

2. The reminder in accordance with claim 1, wherein said timing circuit means activates said refill signal emitter during a second refill reminder time period which begins after said first refill reminder time period has ended.

3. The reminder in accordance with claim 2, wherein said second refill reminder time period delivers the signal during timed turned-on periods which alternate with timed turned-off periods during which the refill signal emitter is off, and said second refill reminder time period varies in relative respective frequency from said first refill reminder time period.

4. The reminder in accordance with claim 3, wherein said turned-off periods of the second refill reminder time period are greater in length than said turned-off time periods of the first refill reminder time period.

5. The reminder in accordance with claim 3, wherein the frequency of said first refill reminder time periods is greater than the frequency of the said second refill reminder time periods.

6. The reminder in accordance with claim 1, wherein said dosage signal turned-on periods and said dosage signal turned-off periods vary in relative respective frequency such that the frequency is greatest for said first one of the plurality of predetermined dosage reminder time periods.

7. The reminder in accordance with claim 1, wherein said timed turned-off periods are shortest for said first one of a plurality of predetermined dosage reminder time periods.

8. The reminder in accordance with claim 1, wherein said predetermined number of doses registered on said dosage accumulator register are preprogrammed into the device without being changeable by the patient.

9. The reminder in accordance with claim 1, further including a power signal emitter and data circuit means associated with said medication dosage accumulator register which activates said power signal emitter after a further predetermined number of doses are registered on said dosage accumulator register, and said activation of the power signal emitter continues until a battery power source of the medication reminder is exhausted.

10. The reminder in accordance with claim 1, further including a selector switch in operative engagement with said timing circuit means, said selection switch varying a dosage regimen time period in order to thereby vary the length of time between individual dosages.

11. The reminder in accordance with claim 1, wherein said casing includes a chamfer along a bottom surface of said casing, and said chamfer is disposed at an acute angle with respect to a transverse axis of the casing.

12. The reminder in accordance with claim 1, further including a magnetic plate associated with a back face of said casing.

13. A preprogrammed medication reminder, comprising:

a casing;

a dosage switch and a dosage signal emitter supported by said casing;

a refill switch and a refill signal emitter supported by said casing;

timing circuit means for controlling said dosage signal emitter and said refill signal emitter and for responding to said dosage switch and to said refill switch;

a medication dosage accumulator register;

said timing circuit means activates said dosage signal emitter during at least a first one of a plurality of predetermined dosage reminder time periods, said timing circuit means delivering the dosage signal during timed turned-on periods which alternate with timed turned-off periods during which the dosage signal emitter is off, said turned-on periods and said turned-off periods vary in relative respective frequency during said dosage reminder time periods;

said dosage switch, when activated, terminates the timed turned-on periods and turned-off periods of the dosage signal emitter and registers the dose delivery on said dosage accumulator register;

data circuit means associated with said medication dosage accumulator register, said data circuit means activates said timing circuit means after a predetermined number of doses are registered on said dosage accumulator register by said actuation of the dosage switch, said timing circuit means activates said refill signal emitter during at least a first refill reminder time period and delivers the signal during timed turned-on periods which alternate with timed turned-off periods during which the refill signal emitter is off;

said refill switch, when activated during said first refill reminder period, terminates said first refill reminder time period;

said predetermined number of doses registered on said dosage accumulator register are preprogrammed into the device without being changeable by the patient;

said timing circuit means activates said refill signal emitter during a second refill reminder time period which begins after said first refill reminder time period has ended;

the frequency of said first refill reminder time periods is greater than the frequency of the said second refill reminder time periods; and said dosage signal turned-on periods and said dosage signal turned-off periods vary in relative respective frequency such that the frequency is greatest for said first one of the plurality of predetermined dosage reminder time periods.

14. The medication reminder in accordance with claim 13, wherein said second refill reminder time period delivers the signal during timed turned-on periods which alternate with timed turned-off periods during which the refill signal emitter is off, and said second refill reminder time period varies in relative respective frequency from said first refill reminder time period.

15. The medication reminder in accordance with claim 14, wherein said turned-off periods of the second refill reminder time period are greater in length than said turned-off time periods of the first refill reminder time period.

16. The medication reminder in accordance with claim 13, wherein said timed turned-off periods are shortest for said first one of a plurality of predetermined dosage reminder time periods.

17. The medication reminder in accordance with claim 13, further including a selector switch in operative engagement with said timing circuit means, said selection switch varying a dosage regimen time period in order to thereby vary the length of time between individual dosages.

18. A method for compliance with a medication prescription regimen, comprising the steps of:

providing a device having a casing, a dosage switch, a dosage signal emitter, a refill switch, a refill signal emitter, circuitry for controlling these emitters and for responding to the activation of these switches, and a medication dosage accumulator register;

said providing step including preprogramming functions of the circuitry so as to provide a predetermined reminder format for dosage compliance and for refill compliance;

initiating the circuitry at a time at which medication is to be administered in accordance with the prescription regimen;

administering medication and operating the dosage switch to add a dosage count to the medication dosage accumulator register;

observing activation of the dosage signal emitter by the circuitry during at least a first one of a plurality of predetermined dosage reminder time periods;

operating the dosage switch to thereby cease the activating step and add a further medication dosage amount to the medication dosage accumulator register;

repeating said observing step and said operating step until a preprogrammed number of doses have accumulated within the medication dosage accumulator register, at which time the circuitry delivers a first signal through the refill signal emitter thereby indicating a prescription refill is now required;

emitting a second refill signal by said refill signal emitter; and acknowledging either or both of said first refill signal and said second refill signal and refilling the medication prescription.

* * * * *